US008529375B2

(12) United States Patent
Ichikawa

(10) Patent No.: US 8,529,375 B2
(45) Date of Patent: Sep. 10, 2013

(54) GOLF BALL HAVING INCREASED MOMENT OF INERTIA

(75) Inventor: Yasushi Ichikawa, Tualatin, OR (US)

(73) Assignee: NIKE, Inc., Beaverton, OR (US)

( * ) Notice: Subject to any disclaimer, the term of this patent is extended or adjusted under 35 U.S.C. 154(b) by 682 days.

(21) Appl. No.: 12/690,881

(22) Filed: Jan. 20, 2010

(65) Prior Publication Data

US 2011/0177885 A1 Jul. 21, 2011

(51) Int. Cl.
*A63B 37/12* (2006.01)
*A63B 37/14* (2006.01)

(52) U.S. Cl.
USPC ..... 473/378; 473/385

(58) Field of Classification Search
USPC ..... 473/378, 385
See application file for complete search history.

(56) References Cited

U.S. PATENT DOCUMENTS

| | | | | | |
|---|---|---|---|---|---|
| 1,482,232 | A | | 1/1924 | Hazeltine | |
| 1,855,448 | A | | 4/1932 | Hazeltine | |
| 2,861,810 | A | * | 11/1958 | Veatch | 473/353 |
| 3,031,194 | A | * | 4/1962 | Strayer | 473/353 |
| 4,235,441 | A | | 11/1980 | Ciccarello | |
| 4,660,830 | A | | 4/1987 | Tomar | |
| 4,863,167 | A | | 9/1989 | Matsuki et al. | |
| 5,427,378 | A | * | 6/1995 | Murphy | 473/353 |
| 5,651,741 | A | | 7/1997 | Masutani et al. | |
| 5,783,293 | A | | 7/1998 | Lammi | |
| 5,827,567 | A | | 10/1998 | Molitor | |
| 5,873,796 | A | | 2/1999 | Cavallaro et al. | |
| 5,984,806 | A | | 11/1999 | Sullivan et al. | |
| 5,994,472 | A | | 11/1999 | Egashira et al. | |
| 6,010,442 | A | * | 1/2000 | Lemons et al. | 473/384 |
| 6,012,992 | A | | 1/2000 | Yavitz | |
| 6,015,356 | A | * | 1/2000 | Sullivan et al. | 473/373 |
| 6,103,166 | A | * | 8/2000 | Boehm et al. | 264/250 |
| 6,193,617 | B1 | | 2/2001 | Mertens | |
| 6,218,453 | B1 | | 4/2001 | Boehm et al. | |

(Continued)

FOREIGN PATENT DOCUMENTS

| | | |
|---|---|---|
| CA | 2728070 | 6/2012 |
| CA | 2775128 | 5/2013 |

(Continued)

OTHER PUBLICATIONS

Extended European Search Report dated May 3, 2011 in European Application No. 11150779.4-2318.

(Continued)

*Primary Examiner* — Gene Kim
*Assistant Examiner* — Matthew B Stanczak
(74) *Attorney, Agent, or Firm* — Plumsea Law Group, LLC

(57) ABSTRACT

Generally disclosed is a golf ball having a core and a cover layer. The cover layer includes a coating material thereon that increases the golf ball's moment of inertia. The coating material is coated on the cover layer in a pattern corresponding to one of the dimple pattern and the pattern of land areas separating the dimples. The golf ball's moment of inertia is increased while utilizing only a small amount of the coating material as a result of the pattern of coating material, which locates the coating material at an outermost radial distance from the golf ball's center of rotation (i.e., the golf ball's center of gravity). The increased moment of inertia causes the golf ball to have a lower rate of spin when hit by a golf club, thereby displaying different play characteristics.

9 Claims, 8 Drawing Sheets

(56) References Cited

U.S. PATENT DOCUMENTS

| | | | | |
|---|---|---|---|---|
| 6,261,193 | B1 * | 7/2001 | Sullivan et al. | 473/377 |
| 6,315,681 | B1 * | 11/2001 | Sullivan | 473/373 |
| 6,342,019 | B1 * | 1/2002 | Boehm et al. | 473/378 |
| 6,383,091 | B1 | 5/2002 | Maruko et al. | |
| 6,392,002 | B1 | 5/2002 | Wu | |
| 6,398,667 | B1 | 6/2002 | Lemons | |
| 6,422,954 | B1 | 7/2002 | Dewanjee | |
| 6,433,094 | B1 | 8/2002 | Nesbitt et al. | |
| 6,454,666 | B1 | 9/2002 | Shira | |
| 6,464,600 | B2 | 10/2002 | Takemura et al. | |
| 6,565,457 | B1 * | 5/2003 | Sullivan et al. | 473/378 |
| 6,575,847 | B1 | 6/2003 | Yamagishi et al. | |
| 6,585,607 | B2 * | 7/2003 | Tzivanis et al. | 473/371 |
| 6,599,203 | B1 * | 7/2003 | Sullivan et al. | 473/378 |
| 6,616,550 | B2 * | 9/2003 | Nesbitt et al. | 473/374 |
| 6,648,776 | B1 * | 11/2003 | Boehm et al. | 473/374 |
| 6,648,778 | B2 * | 11/2003 | Sullivan et al. | 473/377 |
| 6,699,143 | B2 | 3/2004 | Nardacci et al. | |
| 6,743,123 | B2 | 6/2004 | Sullivan | |
| 6,802,787 | B2 | 10/2004 | Ogg | |
| 6,827,657 | B2 | 12/2004 | Sullivan et al. | |
| 6,832,963 | B2 | 12/2004 | Sullivan et al. | |
| 6,835,793 | B2 | 12/2004 | Yokota et al. | |
| 7,022,034 | B2 * | 4/2006 | Sullivan et al. | 473/374 |
| 7,041,011 | B2 | 5/2006 | Sullivan et al. | |
| 7,048,656 | B2 | 5/2006 | Litchfield | |
| 7,125,345 | B2 | 10/2006 | Sullivan et al. | |
| 7,160,209 | B2 | 1/2007 | Marotta et al. | |
| 7,195,564 | B2 | 3/2007 | Han | |
| 7,255,655 | B2 | 8/2007 | Gojny | |
| 7,278,930 | B2 * | 10/2007 | Yokota et al. | 473/378 |
| 7,278,931 | B2 | 10/2007 | Manami et al. | |
| 7,429,220 | B2 | 9/2008 | Kuntimaddi et al. | |
| 7,470,203 | B1 | 12/2008 | Stillinger | |
| 7,601,080 | B2 | 10/2009 | Olson et al. | |
| 7,926,645 | B2 | 4/2011 | Contoli et al. | |
| 2001/0019969 | A1 | 9/2001 | Binette et al. | |
| 2002/0019269 | A1 | 2/2002 | Watanabe | |
| 2004/0132552 | A1 | 7/2004 | Chen | |
| 2008/0064527 | A1 | 3/2008 | Wu et al. | |
| 2008/0081710 | A1 | 4/2008 | Chen et al. | |
| 2008/0251400 | A1 | 10/2008 | Ulrich | |
| 2009/0017941 | A1 | 1/2009 | Sullivan et al. | |
| 2009/0205931 | A1 | 8/2009 | Contoli et al. | |
| 2011/0177884 | A1 | 7/2011 | Ichikawa et al. | |
| 2011/0177887 | A1 | 7/2011 | Ichikawa et al. | |
| 2011/0177890 | A1 | 7/2011 | Tutmark | |

FOREIGN PATENT DOCUMENTS

| | | | |
|---|---|---|---|
| CN | 101002986 | A | 7/2007 |
| CN | ZL201120022039.5 | | 1/2011 |
| CN | 201988125 | | 9/2011 |
| CN | ZL201120021903.X | | 2/2012 |
| CN | ZL201120237927.9 | | 5/2012 |
| CN | ZL201110025876.8 | | 2/2013 |
| EP | 0476147 | | 3/1992 |
| EP | 2347799 | | 1/2013 |
| EP | 2481450 | | 5/2013 |
| JP | 60-171459 | | 11/1985 |
| JP | 06277312 | | 10/1994 |
| JP | 09182814 | | 7/1997 |
| JP | 2002000765 | | 1/2002 |
| JP | 2002224241 | | 8/2002 |
| JP | 2008155013 | | 7/2008 |
| KR | 1087414 | | 11/2011 |
| TW | I303180 | | 11/2008 |
| WO | 9843711 | | 10/1998 |
| WO | 2008118629 | | 10/2008 |

OTHER PUBLICATIONS

European Search Report for European Patent Application No. EP12001388.3, mailed on Jul. 3, 2012.

Office Action for U.S. Appl. No. 12/831,940, mailed on May 10, 2012.

Notification of Grant of Patent Right for Invention issued Oct. 24, 2012 in Chinese Patent Application No. 201110025876.8.

Notification of Grant of Patent Right for Utility Model issued Dec. 23, 2011 in Chinese Patent Application No. 201120021903.X.

Communication under Rule 71(3) EPC mailed May 22, 2012 for European Patent Application No. 11 151 551.6.

Notification of Allowance mailed Oct. 2, 2012 for Canadian Patent Application No. 2,775,128.

Office Action in Utility U.S. Appl. No. 12/690,881, mailed on Nov. 2, 2012.

Communication under Rule 71(3) EPC for European Patent Application No. EP11 150 779.4, mailed Jul. 16, 2012.

Notification of First Office Action in Chinese Invention Patent Application No. 201110025876.8, issued on May 2, 2012.

Notification of First Office Action in Chinese Utility Model Patent Application No. 201120021903.X, issued on Jun. 17, 2011.

Notification of Second Office Action in Chinese Utility Model Patent Application No. 201120021903.X, issued on Sep. 6, 2011.

Result of Consultation in European Patent Application No. EP11 151 551.6, mailed on May 10, 2012.

Office Action in Utility U.S. Appl. No. 12/690,761 mailed on Dec. 18, 2012.

Office Action in Utility U.S. Appl. No. 13/004,829, mailed on Sep. 17, 2012.

Notice of Allowance for Canadian Patent Application No. 2728070, mailed on Nov. 3, 2011.

Communication under Rule 71(3) EPC for European Patent Application No. 12001388.3, mailed on Jan. 4, 2013.

Office Action for Korean Patent Application No. 10-2011-0005899, mailed on Apr. 25, 2011.

Notice of Decision for Patent for Korean Patent Application No. 10-2011-0005899, mailed on Aug. 23, 2011.

Notification of First Office Action for Chinese Invention Patent Application No. 201110025891.2, issued on Dec. 13, 2012.

Notification of Grant of Patent Right for Utility Model for Chinese Utility Model Patent Application No. 201120022039.5, issued on May 19, 2011.

Office Action for U.S. Appl. No. 12/831,940, mailed on Jan. 7, 2013.

Notification of Grant of Patent Right for Utility Model for Chinese Utility Model Patent Application No. 201120237927.9, issued on Jan. 20, 2012.

Communication under Rule 71(3) EPC for European Patent Application No. 11172727.7, mailed on Jan. 17, 2013.

Extended European Search Report for European Patent Application No. 12001388.3, issued on Jul. 3, 2012.

International Search Report for PCT Application No. PCT/US2011/020996, mailed on Jul. 4, 2011.

Extended European Search Report for European Patent Application No. 11151551.6, issued on Jul. 4, 2011.

Extended European Search Report for European Patent Application No. 11172727.7, issued on Jan. 3, 2012.

Office Action for Canadian Patent Application No. 2,728,070, mailed on May 12, 2011.

Office Action for U.S. Appl. No. 12/690,761, mailed on Dec. 18, 2012.

Office Action for Japanese Patent Application No. 2011-003995 mailed on Feb. 19, 2013.

Office Action for Japanese Patent Application No. 2011-005928 mailed on Feb. 19, 2013.

Final Office Action for U.S. Appl. No. 12/690,761 mailed Mar. 26, 2013.

Final Office Action for U.S. Appl. No. 13/004,829 mailed Mar. 26, 2013.

Response to Final Office Action mailed Mar. 26, 2013 for U.S. Appl. No. 12/690,761, filed on May 21, 2013.

Response to Non-Final Office Action mailed Jan. 7, 2013 for U.S. Appl. No. 12/831,940, filed on Jun. 7, 2013.

Response to Office Action mailed Dec. 13, 2012 for Chinese Invention Patent Application No. 201110025891.2 as filed on Apr. 22, 2013 and the English translation thereof.

Response to Office Action mailed Feb. 19, 2013 for Japanese Patent Application No. 2011-003995 as filed on May 13, 2013 and the English translation thereof.

Initiative Amendment as filed on May 7, 2013 for Chinese Invention Patent Application No. 201210375510.8.
Response to Office Action mailed Feb. 19, 2013 for Japanese Patent Application No. 2011-005928 as filed on May 14, 2013 and the English translation thereof.
Notification of Grant of Patent Right for Invention for Chinese Invention Patent Application No. 201110025891.2 mailed on Jun. 4, 2013.
Official Letter and Search Report mailed Apr. 19, 2013 for Taiwan Patent Application No. 99145844 and the English translation thereof.
Official Letter and Search Report mailed Apr. 29, 2013 for Taiwan Patent Application No. 100101631 and the English translation thereof.

* cited by examiner

GOLF BALL HAVING INCREASED MOMENT OF INERTIA

BACKGROUND

The present invention relates generally to a golf ball, and a method of manufacturing the golf ball. In particular, a cover layer on the golf ball includes coated areas such that the golf achieves an increased moment of inertia.

The game of golf is an increasingly popular sport at both the amateur and professional levels. A wide range of technologies related to the manufacture and design of golf balls are known in the art. Such technologies have resulted in golf balls with a variety of play characteristics. For example, different golf balls are manufactured and marketed to players having different golfing abilities, such as different swing speeds.

Accordingly, a golfer may use different golf balls having different play characteristics depending on the golfer's preferences. For example, different dimple patterns may affect the aerodynamic properties of the golf ball during flight, a difference in the cover hardness may affect the rate of backspin, or a difference in the moment of inertia may also affect the rate of backspin. With regard to the moment of inertia in particular, a golfer may choose to use a golf ball having a higher moment of inertia or a lower moment of inertia. A higher moment of inertia will generally result in a lower rate of spin by the golf ball during flight after being struck by a golf club face, while a lower moment of inertia will generally result in a higher rate of spin by the golf ball. Higher rates of spin are generally associated with better controllability, while lower rates of spin are generally associated with increased distance off the tee.

A wide range of golf balls having a variety of moment of inertia characteristics are known in the art. Generally, the moment of inertia of a golf ball is determined by the composition and physical arrangement of the various layers making up the golf ball. Accordingly, a number of different golf ball materials are mixed and matched in various combinations and arrangements to create golf balls having different moments of inertia.

However, designing golf balls to achieve desired moment of inertia characteristics suffers from at least several difficulties. Known golf balls generally use heavy additives interspersed in a polymer matrix comprising one or more outer layers of the golf ball, such that the heavy additive adds weight to an outer radius of the golf ball, in order to increase the golf ball's moment of inertia. However, generally, the construction of known golf balls requires that a wide range of design variables such as layer arrangement, materials used in each layer, and layer thickness be balanced against each other. Changes to any of these variables may therefore achieve a desired moment of inertia only at the expense of other play characteristics. Additionally, materials costs and design costs associated with known golf ball constructions may unduly increase the cost of the golf ball to the end consumer.

Therefore, there is a need in the art for a system and method that addresses the shortcomings of the prior art discussed above.

SUMMARY

In one aspect, this disclosure provides a golf ball comprising: a core having a first density; and a cover layer substantially surrounding the core, the cover layer having multiple dimples and at least one land area separating the dimples; the dimples being arranged on the cover layer in a first pattern; the at least one land area being arranged on the cover layer in a second pattern, the first pattern and the second pattern being non-overlapping patterns; wherein the cover layer is coated with a coating material such that the coating material at least partially overlaps one of the first pattern and the second pattern but substantially does not overlap the other of the first pattern and the second pattern; and wherein the coating material has a second density, the second density being higher than the first density, such that the presence of the coating material increases the moment of inertia of the golf ball.

In another aspect, this disclosure provides a method of manufacturing a golf ball, the method comprising the steps of: (1) receiving a golf ball, the golf ball including a core having a first density and a cover layer substantially surrounding the core, the cover layer having a plurality of dimples and at least one land area separating adjacent dimples, the plurality of dimples being arranged on the cover layer in a first pattern, the at least one land area being arranged on the cover layer in a second pattern, the first pattern and the second pattern being non-overlapping patterns; (2) coating the cover layer with a coating material over at least a portion of at least one of the first pattern and the second pattern, the coating material having a second density, the second density being greater than the first density; and, if necessary (3) selectively removing the coating material from the cover layer; whereby the coating material overlaps at least a portion of one of the first pattern and the second pattern but substantially does not overlap the other of the first pattern and the second pattern, and the presence of the coating material increases the moment of inertia of the golf ball.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Generally, the present disclosure relates to a golf ball having an increased moment of inertia. The increased moment of inertia is achieved by coating a dense material onto the cover layer in a selected pattern. The pattern may correspond to the plurality of dimples, or the pattern may correspond to at least one land area separating at least two dimples. Coating the dense material in a selected pattern increases the golf ball's moment of inertia while also affording the golf ball other advantageous physical properties, such as a desirable hardness pattern. In one embodiment, coating the dense material in a pattern corresponding to at least one land area separating at least two dimples results in an increased moment of inertia while using minimal dense material due to the dense material being added at the farthest radial distance from the golf ball's center of gravity.

This disclosure further relates to methods of manufacturing such a golf ball.

The moment of inertia of a body is a measure of an object's resistance to changes in its rotation rate. Generally, when a body having a high moment of inertia is imparted with a certain rotational energy, the body will rotate at a rate that is slower than the rate at which a body having a low moment of inertia will rotate when imparted with the same amount of rotational energy. The moment of inertia of a spinning body is generally defined as the integral of $r^2$*dm, where r is the radial distance to the axis of rotation and dm is the differential of the mass at that radius r. Moment of inertia has units of mass times distance squared, for example in SI units: kg*$m^2$. The moment of inertia of a uniform solid sphere is given by the equation (2/5)*mass*$radius^2$. However, a golf ball is not uniform, but instead varies in density among its several layers. The present disclosure changes the rotational performance characteristics of a golf ball by coating a dense material on an outermost layer of the golf ball in a selected pattern.

Figure 1:
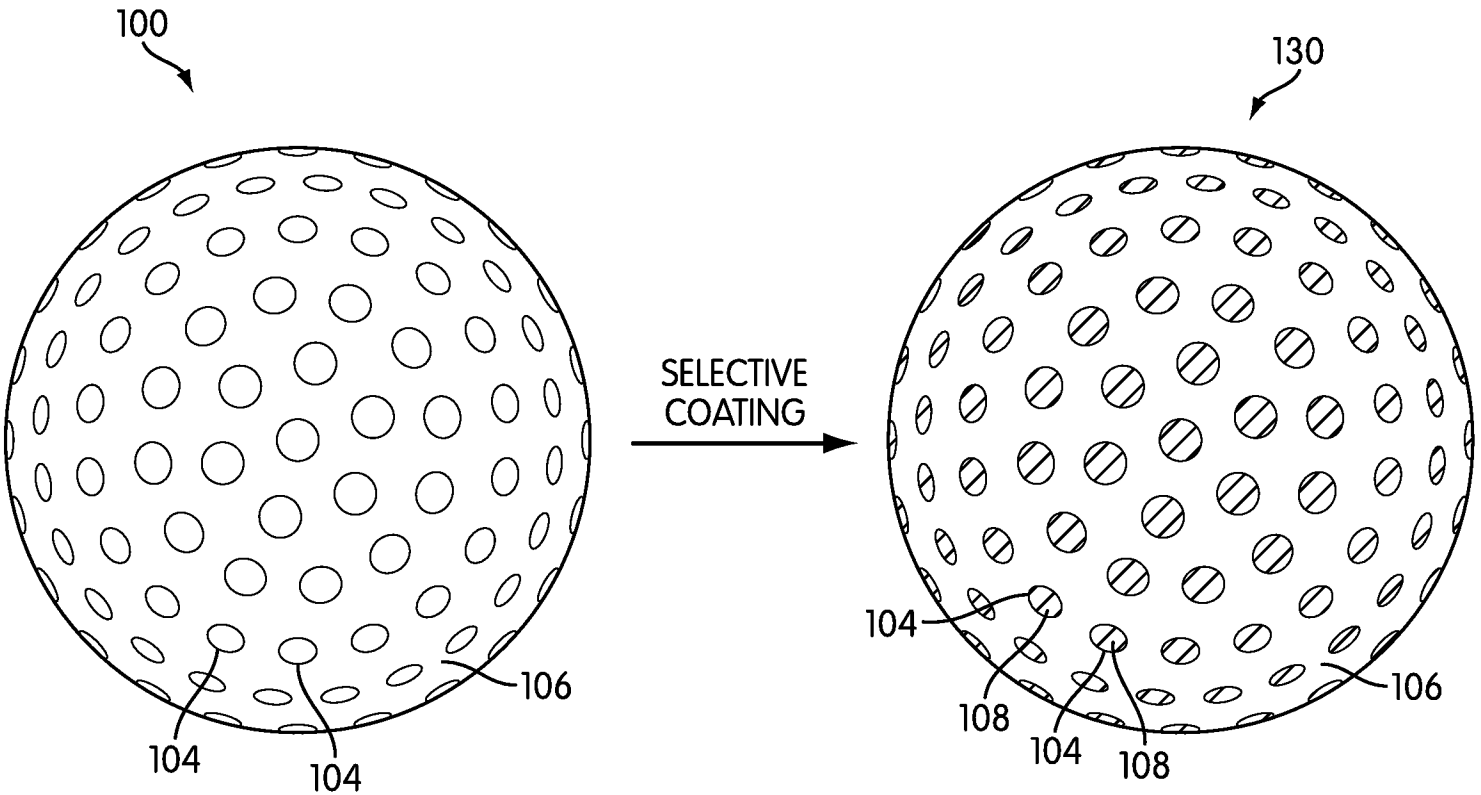
FIG. 1 shows an exemplary golf ball before and after selective coating.

FIG. 1 shows an exemplary golf ball in accordance with this disclosure. Golf ball 100 is made up of a cover layer having thereon a plurality of dimples 104 and at least one land area 106. Golf ball 100 may generally be any type of golf ball having a core and a cover layer substantially surrounding the core. For example, golf ball 100 may be of a two-piece construction, having only a core and a cover layer, or golf ball 100 may have one or more intermediate layers located between the core and the cover layer. Except as otherwise herein discussed, each layer of golf ball 100 may be formed of any material or construction as is generally known in the art of golf ball manufacturing. For example, various layers of golf ball 100 may be comprised of rubber, rubber composites, thermoplastic polyurethane, highly-neutralized polymers, ionomers, and other polymer materials as are known in the art of golf ball manufacturing.

The plurality of dimples 104 may generally be arranged on the cover layer in a first pattern. The first pattern may generally be any dimple-packing pattern, as may be known in the art of golf balls. Dimples 104 may generally be of any shape, such as circular, triangular, or multi-sided. Dimples 104 may be of uniform shape and size, or the dimple pattern may be made up of two or more different types of dimples having (for example) different sizes or different shapes. At least one land area 106 is a part of the cover layer that separates at least two dimples 104 and that is not indented or otherwise part of a dimple. Generally, land area 106 is the "ridge" or "fret" between adjoining dimples 104. Golf ball 100 may include one continuous land area 106 across the entire cover layer, as is shown in FIG. 1, or a plurality of separate land areas between the plurality of dimples 104. At least one land area is arranged on the cover layer in a second pattern. The first pattern (corresponding to the dimples) and the second pattern (corresponding to the land between the dimples) are different, non-overlapping patterns.

Figure 6:
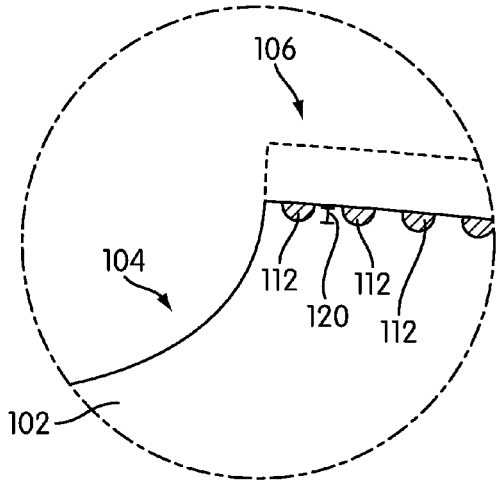
FIG. 6 shows a close-up cross section of a portion of a golf ball cover layer, after a part of a selective coating has been removed.

In the embodiment shown in FIG. 1, golf ball 100 undergoes selective coating so as to be changed into golf ball 130. The selective coating process itself is discussed in greater detail below. By the selective coating process, a coating material 108 is selectively applied on the first pattern (corresponding to the dimples 104). Although FIG. 6 shows the entirety of the first pattern (i.e., all of the dimples) being coated with coating material 108, coating material 108 may alternatively coat only a portion of the first pattern. Generally, in this embodiment, coating material 108 may overlap at least a portion of the first pattern, but does not substantially overlap the second pattern.

Figure 2:
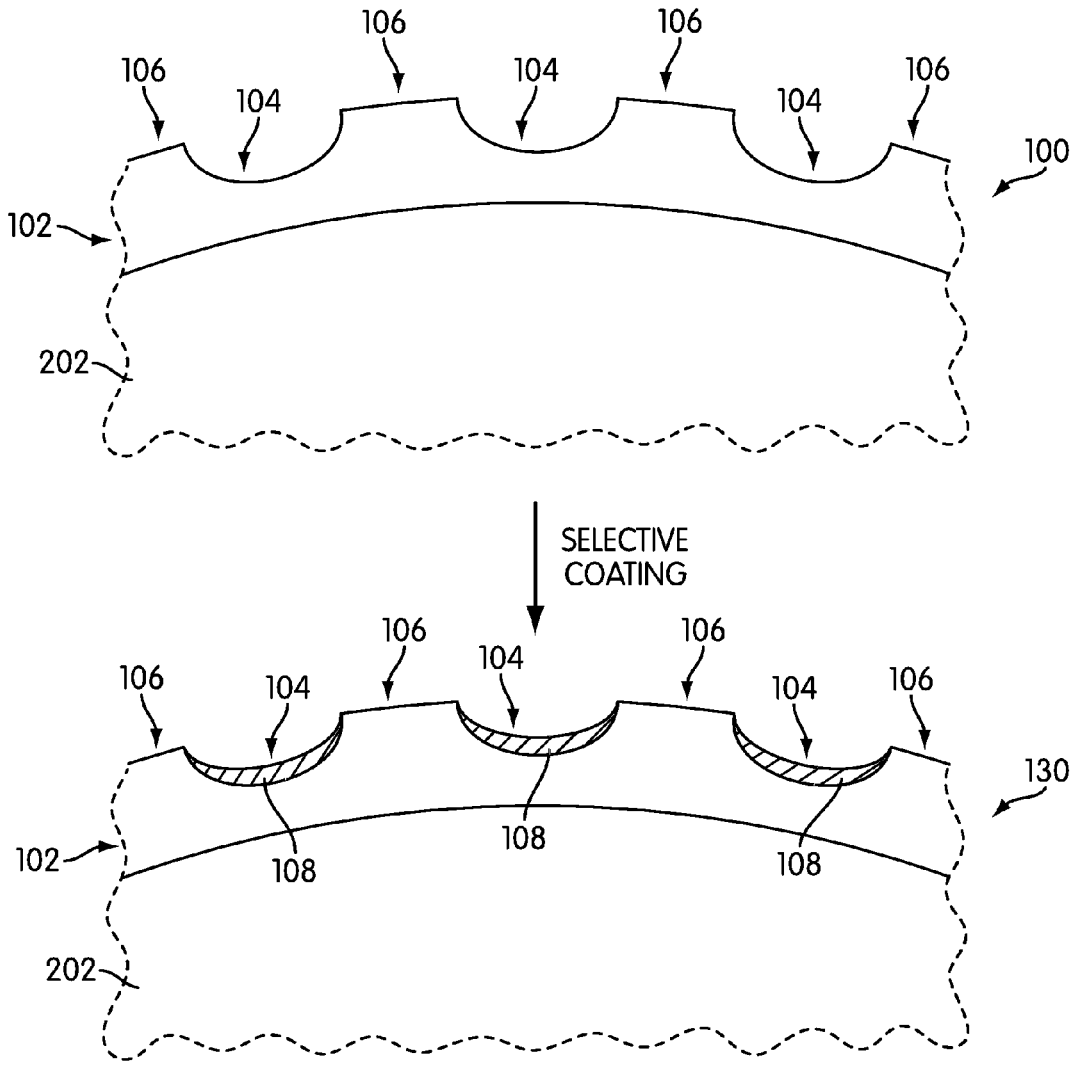
FIG. 2 shows a cross section of the golf ball shown in FIG. 1, before and after the selective coating.

FIG. 2 shows a cross-sectional view of the dimples 104 and land areas 106 shown in FIG. 1. In FIG. 1, coating material 108 is coated on top of each of the dimples 104, forming a thin layer of coating material 108 on a cover layer 102. Generally, cover layer 102 substantially surrounds a core 202, and includes the dimples 104 and land areas 106 thereon. Although core 202 is shown to be in direct contact with cover layer 102 in FIG. 2, the golf ball 100 or 130 may include one or more intermediate layers between core 202 and cover layer 102 as may be desired and as are known in the art of golf ball construction.

The thickness of coating material 108 may generally be any thickness that fits within a dimple. Coating material 108 should generally not be so thick as to significantly affect the aerodynamics of the golf ball, however coating material 108 may be applied in such a way as to achieve a desired dimple depth configuration. In certain embodiments, cover layer 102 may have a thickness of about 2 mm or less. A clear coating layer (not shown) on top of cover layer 102 may generally have a thickness of about 20 microns. Accordingly, in these embodiments, coating material 108 may have a thickness that is, for example, on the order of about 20 microns or less. Generally, coating material 108 may have a thickness of about 1 micron to about 20 microns (about 0.001 mm to about 0.02 mm), inclusive and taking into account manufacturing tolerances.

Figure 3:
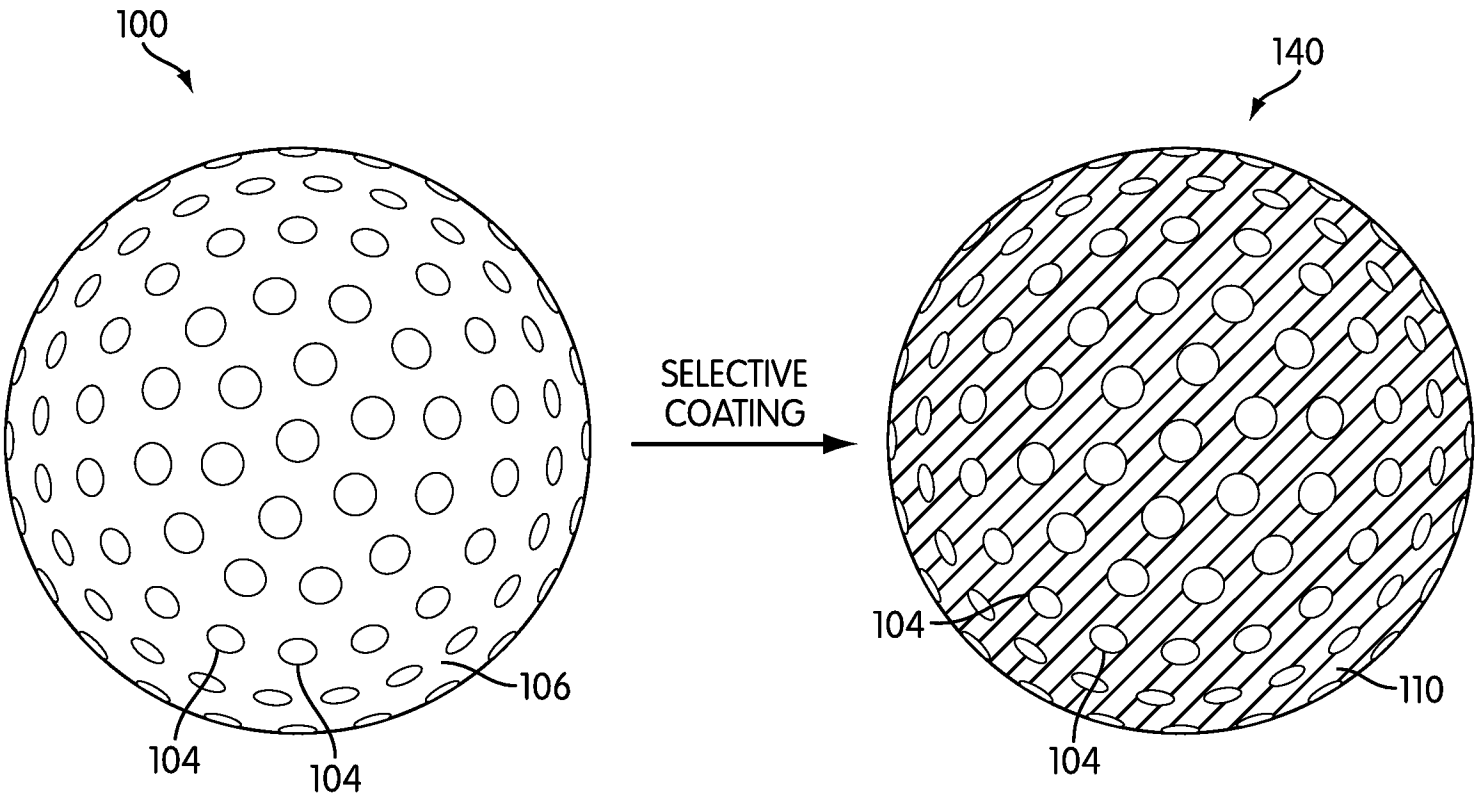
FIG. 3 shows an alternative embodiment of a golf ball, before and after selective coating.

FIG. 3 shows a second embodiment, wherein land areas 106 of golf ball 100 are coated with a coating material 110 so as to produce golf ball 140. In this embodiment, coating material 110 covers the entirety of the second pattern (corresponding to the land areas), as shown. However, more generally, coating material 110 covers at least a part of the second pattern, and does not substantially overlap the first pattern. Coating material 110 may therefore overlap some portion less than the entirety of the second pattern, or the entirety of the second pattern, as may be desired.

Figure 4:
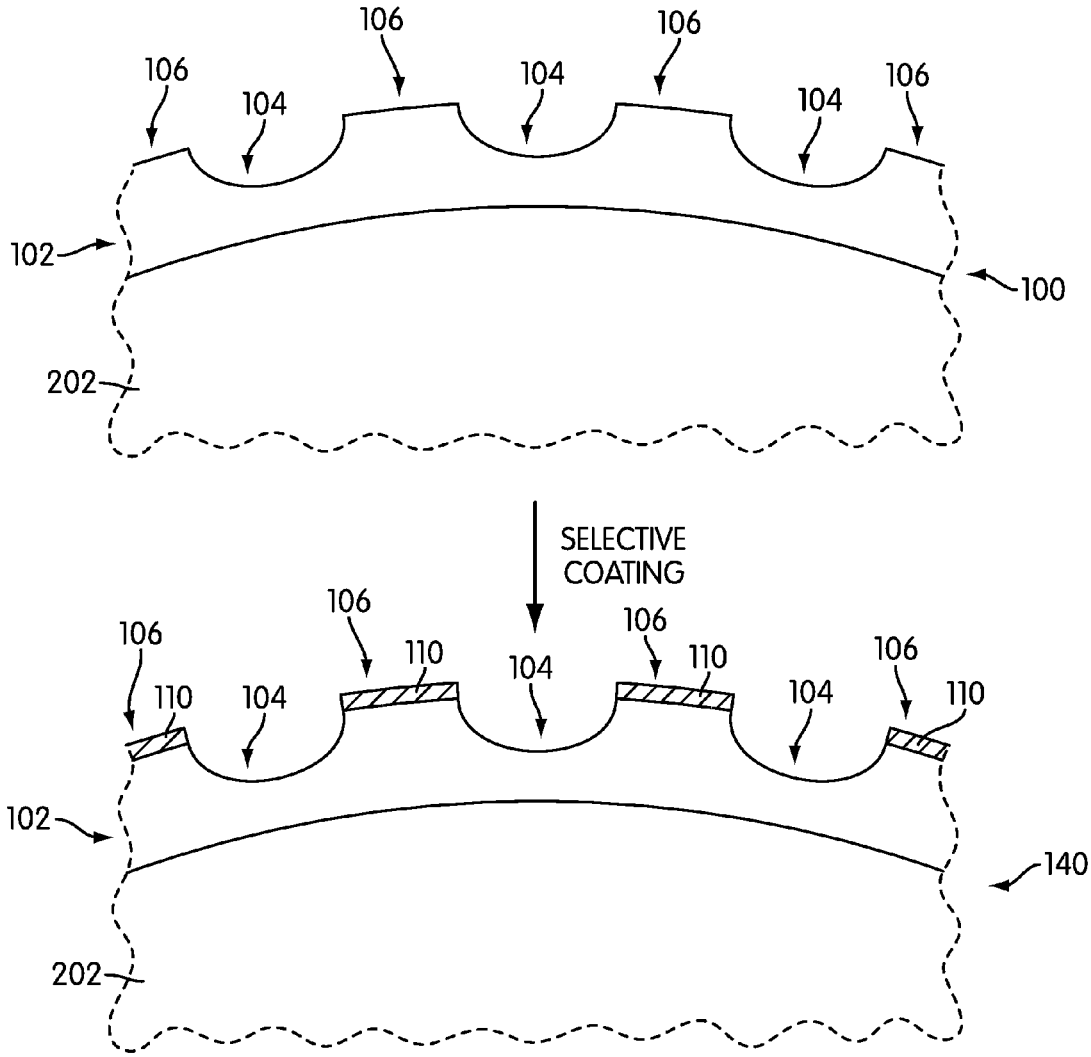
FIG. 4 shows a cross section of the golf ball shown in FIG. 3, before and after the selective coating.

FIG. 4 shows a cross-sectional view of the embodiment of FIG. 3. Specifically, land areas 106 on golf ball 100 are selectively coated with coating material 110 to form golf ball 140. As was discussed with respect to coating material 108, coating material 110 should generally not be so thick as to significantly affect the aerodynamics of the golf ball, however coating material 110 may be applied in such a way as to achieve a desired dimple depth configuration. Accordingly, coating material 110 may have a thickness that is, for example, on the order of about 20 microns or less. In one embodiment, coating material 110 has a thickness of between about 1 micron and about 20 microns, inclusive and taking into account manufacturing tolerances. Coating material 110 may have a thickness that is slightly smaller than a thickness of coating material 108 for an equivalent moment of inertia of the golf ball, because coating material 110 is applied at a further radial distance from the center of the golf ball 140.

Figure 5:
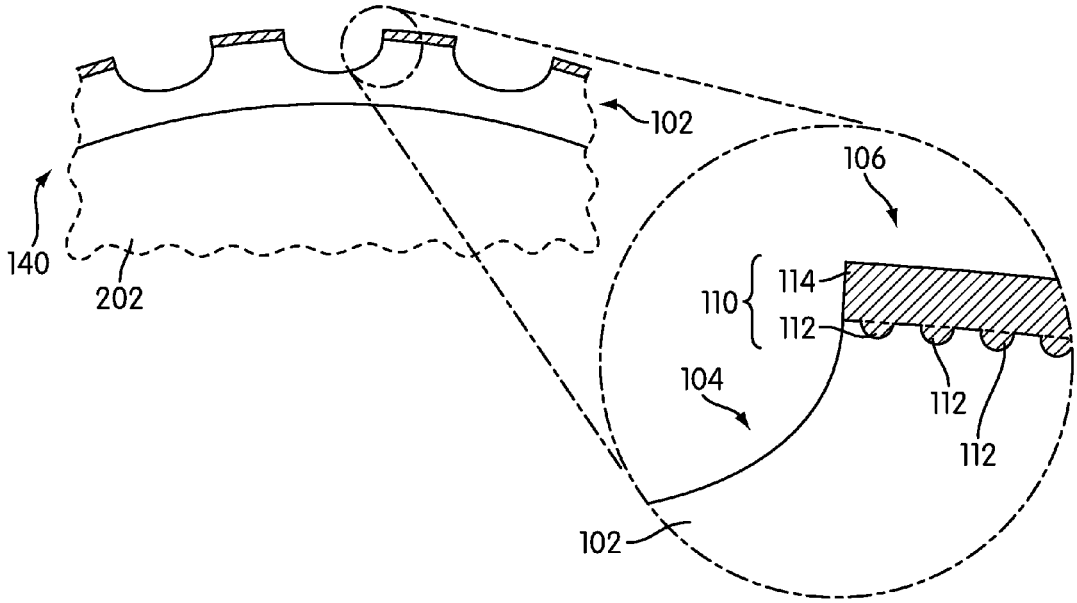
FIG. 5 shows a cross section of a portion of a golf ball cover layer, in further detail.

FIGS. 5 and 6 show a further feature of the coating that may be used in conjunction with either of the above discussed embodiments. Specifically, FIG. 5 shows several pockets 112 in the surface of cover layer 102. Generally, pockets 112 are small indentations or abrasions intentionally formed in the surface of cover layer 102. Pockets 112 generally have a depth 120 that is at least less than the depth of dimple 104, and, in some embodiments, significantly less than the depth of dimples 104. In embodiments where cover layer 102 has a thickness of about 2.0 mm, pockets 112 may have a depth 120 of less than about 0.5 mm, or less than about 0.3 mm, or less than about 0.1 mm. Furthermore, depth 120 may be an even shorter depth, such as less than about 20 microns, or generally of any value between about 1 micron and 20 microns, inclusive and taking into account manufacturing tolerances.

Pockets 112 may enable coating material 108 to better adhere to cover layer 102. Pockets 112 may also allow more flexibility in the design of the golf ball, such as by achieving a desired moment of inertia without, for example, significantly changing the dimple depth or total diameter of the golf ball.

When coating material 110 is coated on cover layer 102 having pockets 112 therein, coating material 110 fills the pockets 112 as well as coats the surface of cover layer 102 with a top section 114 of coating material 110. Top section 114 of coating material 110 may be left in place on the second pattern on top of land areas 106, if desired, or may be removed to leave coating material 110 only in the pockets 112. FIG. 6 shows coating material 110 present only in pockets 112. As shown in FIG. 6, coating material 110 is located in pockets 112, but does not otherwise substantially overlap or extend over the top of the surface of cover layer 102.

Figure 7:
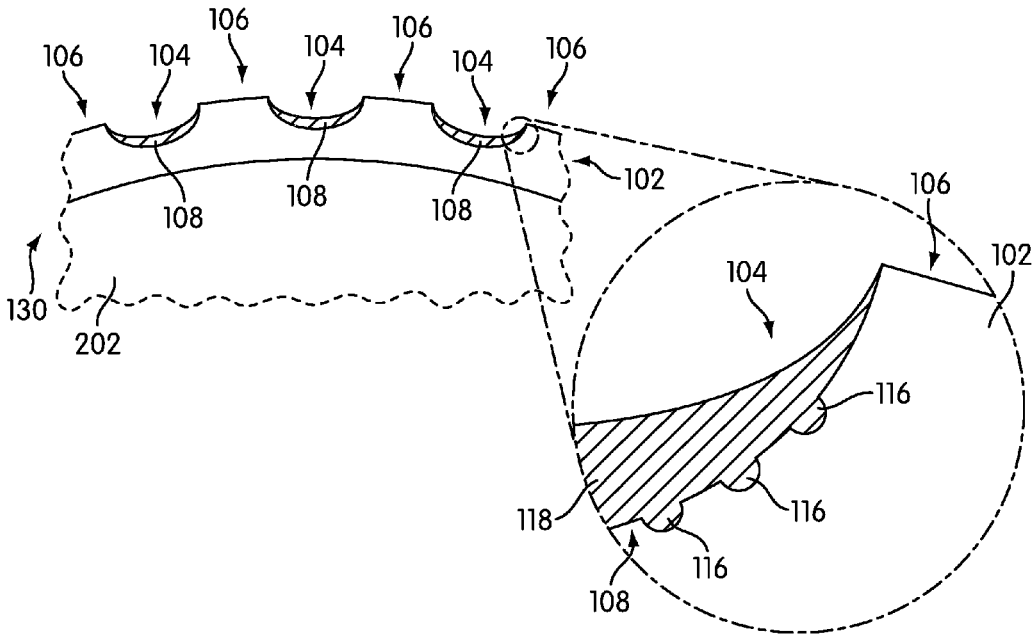
FIG. 7 shows a second embodiment of a cross section of a portion of a golf ball cover layer, in further detail.
Figure 8:
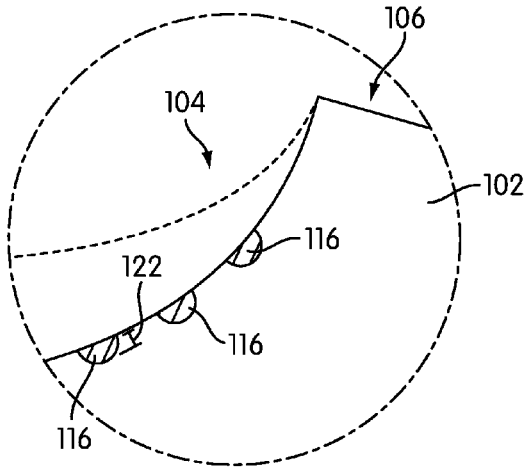
FIG. 8 shows a second embodiment of a close-up cross section of a portion of a golf ball cover layer, after a part of a selective coating has been removed.

FIGS. 7 and 8 show an embodiment wherein dimple pockets 116, which are similar to pockets 112 in that they are made or formed in the surface of cover layer 102, but dimple pockets 116 are located in those portions of cover layer 102 which include dimple 104. Similar to as discussed above with respect to FIGS. 5 and 6, coating material 108 may include a top section 118 as well as fill dimple pockets 116. Top section 118 of coating material 108 may then be removed, if so desired, leaving coating material 108 only in pockets 116. Dimple pockets 116 in or on or proximate to dimple 104 have a depth 122 that may be the same as or different from depth 120 of pockets 112 associated with land area 106.

In these embodiments including pockets 112 and/or pockets 116, generally, the coating material may be used to change the moment of inertia in accordance with this disclosure, without changing the diameter or aerodynamic performance of the golf ball. Therefore a wider range of golf ball designs may be used in accordance with the present disclosure, without the need to redesign the physical structure of the golf ball or sacrifice advantageous aerodynamic properties.

The golf ball in accordance with the present disclosure achieves an increased moment of inertia due to the density of the coating material being higher than the density of the core. As shown in FIGS. 4-8, generally, core 202 of the golf ball 100 has a first density, and coating material 108 or coating material 110 has a second density, where the second density is higher than the first density. The coating material 108 or 110 therefore increases the moment of inertia of the golf ball 130 or 140, because more of the golf ball's mass is located at an outer radial distance from the golf ball's axis of rotation (the golf ball's axis of rotation being the golf ball's center of gravity).

The coating material may generally be any material having a density that is greater than the density of the core. A wide range of polymers are known in the art that may be manufactured to have high density values. Generally, the polymer making up the coating material may be any thermoplastic, thermoset, ionomer, copolymer, or other polymer material known and used in the art of golf balls so long as the polymer has a density that is greater than the density of the core. The density of a polymer coating material may be determined in accordance with ASTM D792, for example, or in accordance with other known measurement standards.

Additionally, the coating material may be a metal plating. Nearly any typical metal may be used, as most metals have a density that is significantly higher than the polymer materials conventionally used to form golf ball cores. Exemplary metals that may be used as the coating material include aluminum, steel, tungsten, titanium, magnesium, and iron alloys, and mixtures thereof, among a variety of other metals. The metal coating material may be selected based on density, hardness, workability, and cost effectiveness, for example, among other selection criteria.

Figure 9:
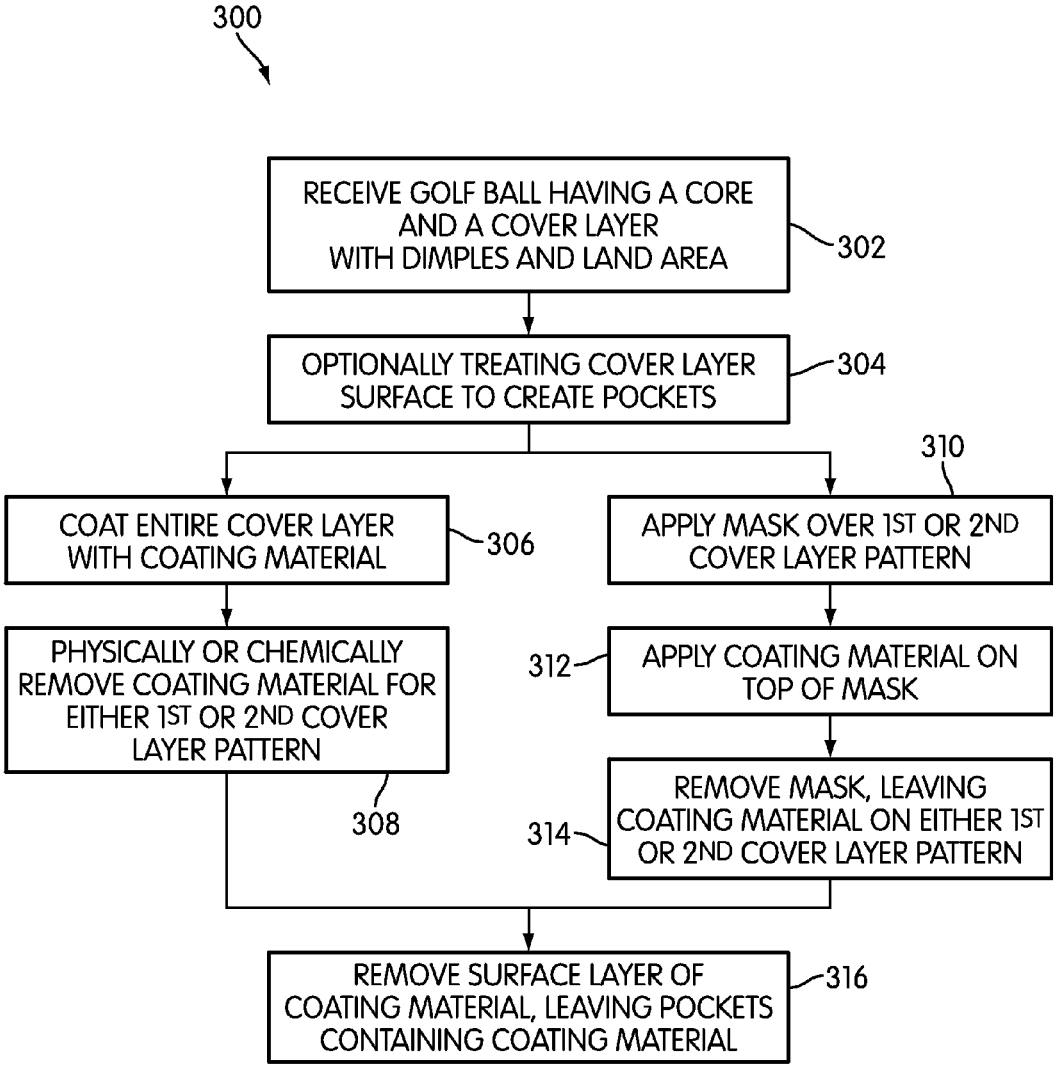
FIG. 9 is a flowchart detailing a method of manufacturing a golf ball, including optional steps.

FIG. 9 is a flowchart detailing a method of manufacturing the golf balls discussed above, including optional steps. Generally, a method 300 of manufacturing a golf ball includes first step 302 of receiving a golf ball having a core with a first density and a cover layer substantially surrounding the core, where the cover layer includes a plurality of dimples and at least one land area thereon. The plurality of dimples is arranged on the cover layer in a first pattern, and the at least one land area is arranged on the cover layer in a second pattern, the first and the second patterns being non-overlapping patterns.

The golf ball may then undergo an optional preliminary step of treating the cover layer so as to create pockets 112 in the cover layer. This preliminary treatment step may be, for example, a physical surface roughening, or a chemical etching that etches only a small portion of the cover layer such as an unmasked portion of the surface of the golf ball.

Next, method 300 of manufacturing the golf ball may take either of two general routes. In a first step 306 of a first route, the entire cover layer is coated with the coating material. The coating step 306 may be a physical coating step, such as by brushing, dipping, spraying or other physical application means. Alternatively, the coating step 306 may be a chemical coating step, such as chemical vapor deposition (CVD), plasma spray coating, or other chemical application means. The coating material is then selectively removed in step 308, such that the coating material remains on only either of the first or second pattern, as desired. The removal of the coating material 308 may be a physical grinding away of the coating, or may be a chemical removal such as by chemical etching using a mask to protect selected coated areas to prevent the removal of selected coated areas.

Alternatively, in step 310 a mask may be applied over the golf ball. The mask may be a physical mask having a pattern of holes corresponding to either of the first pattern or the second pattern. The coating material is then 312 applied on top of the mask, after which 314 the mask is removed, leaving the coating material on only the pattern corresponding to the holes in the mask.

Finally, if the golf ball underwent step 304 to create pockets, the surface portion of the coating material 114 may be removed in step 316. This step leaves the coating material in only the pockets, and not otherwise substantially overlapping the surface of the cover layer. Accordingly, a golf ball 130 or 140 is manufacturing having an increased moment of inertia as compared to a golf ball 100 prior to the manufacturing method 300.

Figure 10:
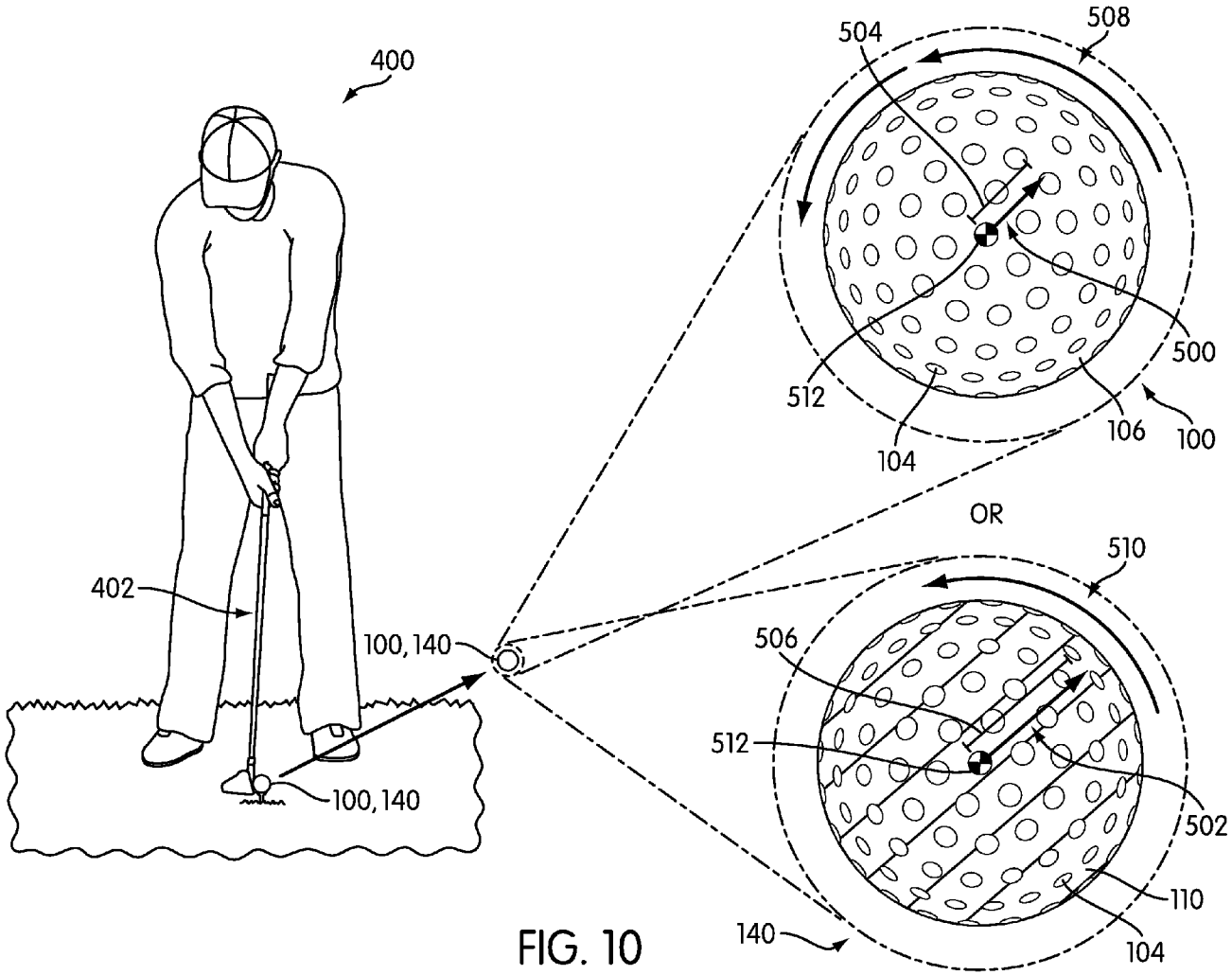
FIG. 10 shows a golfer hitting a golf ball, and a comparison of the play characteristics of two golf balls.

A comparative illustration of golf ball 100 with golf ball 140 is shown in FIG. 10. A golfer 400 swings a golf club 402 toward a golf ball on a tee. If the golf ball on the tee is golf ball 100, then golf ball 100 will exhibit play characteristics as shown in the upper half of FIG. 10 upon being struck by golf club 402. Specifically, golf ball 100 will exhibit a high rate of rotation 508 around its center of gravity 512 because its moment of inertia, as graphically illustrated by the length 504 of moment arm 500, is relative low. On the other hand, golf ball 140 exhibits a lower rate of rotation 510 about the center of gravity 512 because its moment of inertia, as graphically illustrated by the length 506 of moment arm 502, is relatively high. Accordingly, golf ball 140 will display different play characteristics than golf ball 100, and so may be more desirable to certain golfers based on the golfers' preferences.

Furthermore, golf balls made in accordance with this disclosure may also simultaneously achieve improved play characteristics that are unrelated to the moment of inertia. Specifically, such golf balls may also achieve desired hardness patterns, as is fully described in U.S. Patent Application Publication No. 2011/0177884, entitled Golf Ball With Cover Having Varying Hardness, and filed on Jan. 20, 2010, the disclosure of which is hereby incorporated in its entirety.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A golf ball comprising:

a core having a first density; and a cover layer substantially surrounding the core, the cover layer having multiple dimples and at least one land area separating the dimples;

the dimples being arranged on the cover layer in a first pattern;

the at least one land area being arranged on the cover layer in a second pattern, the first pattern and the second pattern being non-overlapping patterns;

wherein the cover layer is coated with a coating material such that the coating material at least partially overlaps one of the first pattern and the second pattern but substantially does not overlap the other of the first pattern and the second pattern; and wherein the coating material has a second density, the second density being higher than the first density, such that the presence of the coating material increases the moment of inertia of the golf ball;

wherein a surface of the cover layer corresponding to one of the first pattern and the second pattern includes pockets in the surface of the cover layer, and the coating material is coated on the same one of the first pattern and the second pattern such that the coating material completely fills the pockets, wherein each pocket has a depth that is from about 1 micron to about 20 microns; and wherein the coating material has a thickness of about 20 microns.

2. The golf ball of claim 1, wherein the coating material is a metal.

3. The golf ball of claim 1, wherein the coating material at least partially overlaps the first pattern but does not substantially overlap the second pattern.

4. The golf ball of claim 3, wherein the coating material substantially entirely overlaps the first pattern.

5. The golf ball of claim 1, wherein the coating material at least partially overlaps the second pattern but does not substantially overlap the first pattern.

6. The golf ball of claim 5, wherein the coating material substantially entirely overlaps the second pattern.

7. The golf ball of claim 1, wherein the coating material completely fills the pockets such that the coating material has a first top surface in each pocket that is level with a second top surface of the coating layer outside of each pocket.

8. The golf ball of claim 7, wherein the coating material is located in the pockets but does not otherwise substantially overlap the surface of the cover layer.

9. The golf ball of claim 1, wherein the coating material is a polymer.

* * * * *